US005497946A

United States Patent [19]

Laidler

[11] Patent Number: 5,497,946

[45] Date of Patent: Mar. 12, 1996

[54] SELF-CLEANING/UNBLOCKING SPRAY NOZZLE

[75] Inventor: Kevin O. Laidler, Stourbridge, United Kingdom

[73] Assignee: Incro Limited, Stourbridge, United Kingdom

[21] Appl. No.: 281,225

[22] PCT Filed: Jul. 27, 1994

[86] PCT No.: PCT/GB93/02475

§ 371 Date: Jul. 27, 1994

§ 102(e) Date: Jul. 27, 1994

[87] PCT Pub. No.: WO94/13409

PCT Pub. Date: Jun. 23, 1994

[30] Foreign Application Priority Data

Dec. 5, 1992 [GB] United Kingdom ..... 9225478
Jul. 5, 1993 [GB] United Kingdom ..... 9313869

[51] Int. Cl.[6] ..... B05B 1/32; B05B 15/02; B05B 1/34

[52] U.S. Cl. ..... 239/452; 239/106; 239/464; 239/533.13

[58] Field of Search ..... 239/451–453, 239/455, 456, 459, 460, 464, 533.1, 533.13, 537, 541, 489, 104, 106

[56] References Cited

U.S. PATENT DOCUMENTS

| | | | |
|---|---|---|---|
| 1,040,899 | 10/1912 | Dahmen | 239/452 |
| 3,739,983 | 6/1973 | Jousson | 239/452 |
| 4,789,104 | 12/1988 | Anderson | 239/455 |

FOREIGN PATENT DOCUMENTS

| | | | |
|---|---|---|---|
| 482369 | 4/1992 | European Pat. Off. . | |
| 1326336 | 7/1987 | U.S.S.R. | 239/464 |
| 817998 | 8/1959 | United Kingdom . | |
| 987723 | 3/1965 | United Kingdom . | |

*Primary Examiner*—Karen B. Merritt
*Attorney, Agent, or Firm*—Neil F. Markva

[57] ABSTRACT

A self-unblocking spray nozzle 10,11 in which an easily removable insert 12 is automatically moved by fluid pressure to form a spray orifice 26, and expands resiliently when the fluid pressure is interrupted. The insert 12 may include swirl vanes 33 to rotate the fluid, and may operate with a static member 14 to form an automatic anti-drip valve.

27 Claims, 4 Drawing Sheets

SELF-CLEANING/UNBLOCKING SPRAY NOZZLE

BACKGROUND OF THE INVENTION

Spray nozzles are well known devices for producing controlled sprays of liquids for applications such as paint spraying, crop spraying to dispense fertilizer and insecticide, industrial washing and chemical treatment. For most applications it is essential for a spray nozzle to produce an evenly distributed spray of uniform liquid particles in a predetermined spray pattern.

In most cases the spray pattern consists of fine droplets created by forcing liquid into the nozzle through a large orifice and out of the nozzle through a smaller discharge orifice or plurality of smaller discharge orifices. The finer the droplets required, the smaller the size of the discharge orifice. The discharge orifices in known spray nozzles are usually outlet openings of a static nature and preset dimensions, e.g. holes drilled or molded into the ends of nozzle members. The outlet openings or holes, being of small size, have a tendency to block frequently with particles of dirt, crystals and other matter present in the liquid or the spraying equipment.

Conventional methods of removing trapped particles to clean the spray nozzle and allow liquid to flow properly are very labor intensive. The spray nozzles need to be removed frequently from the spraying equipment and cleaned out by hand. Often there are large numbers of spray nozzles and they can be difficult to access locations. The spray nozzles can also be contaminated with toxic or corrosive liquid if that is the nature of the material passing through the nozzle. While this cleaning process is undertaken, production cannot continue which is extremely costly.

In order to reduce the need for frequent cleaning of the nozzles there is disclosed in GB 0987723 a spray nozzle comprising a hollow member having an outlet opening at its front end, and a movable device within the hollow member. The movable device comprises a plurality of separable segmental parts, and the device can be moved by fluid pressure to move the segmental parts towards each other to create a spray discharge orifice at the front end of the nozzle.

The segmental parts can separate when relieved of fluid pressure, so that the discharge orifice can be opened-up for releasing particles so as to tend to prevent collection of matter which could block the orifice.

However, this known spray nozzle has the disadvantage that when orientated so that the open end is lowermost, the segmental parts remain together and fail to release such matter.

There is disclosed in EP 0482369A, a nozzle in which the rear ends of the separable parts have radially outwardly projecting flanges which are engaged by a rear end of a helical compression spring, located in an annular space between the movable device and the hollow member, to thrust the device rearwards away from the open front end of the hollow member. To prevent fluid by-passing the device (by flowing through this annular space), the flanged rear ends carry a packing ring which seals against the internal surface of the hollow member. Additionally, the rear end part of the hollow member is fitted internally with a retaining ring to retain the spring, packing ring and separable parts within the hollow member. In order to force such separable parts to separate when fluid pressure is removed from the nozzle, surfaces of said flanges are inclined so that the spring acts thereon in an attempt to urge apart the front ends of the separable parts, to try to cause the orifice to open when the device is moved rearwards to abut the retaining ring.

The nozzle of EP 0482369A gives rise to more problems than it solves. For example, the spring acts primarily in the axial (front to rear) direction, and thus the packing ring is necessary to ensure that the fluid pressure generates enough force on the device to overcome the thrust of the spring, but a consequence is that (upon the fluid supply being halted) when the device moves rearwards the volume of said annular space increases, sucking in air and/or fluid back into the space at the same time as the separable parts are being separated, with the resultant probability that clogging matter will be drawn into the annular space. Presence of such matter in the annular space, and especially in the slight gap between the flanges and the hollow member, can cause the nozzle to malfunction.

However, the main problem inherent in said nozzle is that it is complex, expensive to make and designed to be replaced as a pre-assembled unit. It is clearly not designed to be dismantled easily for on-site cleaning and would be even more difficult or nearly impossible to reassemble without renewing the rings, thus requiring the user to carry on site stocks of spare nozzles for every spray variant, flow rate and etc type of nozzle employed.

The present invention accepts that some blockages or malfunctions are probably inevitable even with nozzles which are designed to be self-cleaning, and seeks to avoid the problems of manufacturing complexity and spare parts costs.

SUMMARY OF THE INVENTION

The primary object of the invention is to avoid or reduce said problems in respect of a spray nozzle of a kind generally comprising a hollow member having an outlet opening therein at the front of the spray nozzle, a movable device disposed within the nozzle and rearwardly biased to a normal position in which the outlet opening is minimally restricted or is unrestricted by the movable device. The movable device of the invention is movable by fluid pressure from the normal position in a forwards direction towards the outlet opening to obstruct the flow to the outlet opening and to cause relative movement between separable parts of the movable device to create a spray discharge orifice, smaller than the outlet, within or proximal to the outlet opening. The present invention is characterized in that the operationally movable parts of the spray nozzle for forming the discharge orifice and providing said bias are all contained within or incorporated into the movable device.

Thus, the movable device can be removed as a unit to facilitate on-site servicing of the spray nozzle.

In order to further avoid said problems and to reduce the risk of malfunction, the present invention further provides a spray nozzle of said kind characterized in that the hollow member has provided therein a sealing abutment surface adjacent the outlet opening, and the separable parts have sealing surfaces on their front ends to engage the abutment surfaces to provide a seal in the operative position of the movable device to prevent fluid by-passing the discharge orifice or orifices.

Thus, the remainder of the movable device to the rear of said seal can be a clearance fit in the nozzle, for ease of removal of the device and to minimize friction and risk of matter impeding movement of the movable device.

In preferred embodiments, a nozzle of said kind is characterized according to the present invention in that transverse biasing means is provided in or by the movable device to urge said separable parts to separate and react against an inclined internal surface of the spray nozzle to provide said rearwards to bias indirectly as the separable parts move rearwardly along the inclined surface under the influence of the transverse biasing means.

In a specific embodiment:

(a) said internal surface is part conical, converges towards the outlet opening and is inclined to the axis of the nozzle at an angle within the range of 20° to 40°, preferably 25° to 35°;

(b) the transverse biasing means comprises a resilient member accommodated inside the movable device between said separable parts; and (c) said movable device or said resilient member is shaped to impart rotational motion to fluid passing through the movable device.

By arranging the biasing means to act directly in the separating direction on the separable parts of the device, reliable separation is ensured; and by providing the biasing means in the movable device all the above-mentioned problems associated with the known helical springs, spring receiving annular spaces, packing rings and retaining rings are avoided.

In known spray nozzles, the separable parts are individual elements which are discrete from each other, and can be moved to abut in the operative position of the device. In order to further reduce said problems and the cost of the device, said separable parts are preferably parts of a single body which can flex to permit relative movement between said separable parts of the body.

In accordance with the present invention, some preferred embodiments of nozzle of said kind are characterised in that the movable device comprises a body incorporating said separable parts, and in that the flexible body is at least partially resilient, and serves to provide said rearwards bias by urging the separable parts away from each other to react against an internal surface of the spray nozzle.

The integration of the biasing means and the separable parts into a single body makes the spray nozzle extremely inexpensive, resistant to malfunction and easy to service; and furthermore avoids all the well known problems inherent in metal coil springs, such as corrosion, breakage and malfunction, to which such springs are particularly liable when used in a corrosive or damp environment.

Furthermore, simple exchange of bodies can be employed to give a change of spray characteristics, without having to change the other parts of the spray nozzles. For example, it is known to fit a vaned insert into an ordinary static non-self-clearing spray nozzle, in order to impart rotational momentum to the fluid in the nozzle, but in EP 0482369A the separable parts occupy the space required for such a vaned insert.

In order to solve this additional problem, the present invention further provides a spray nozzle of said kind which is characterized in that the movable device is hollow and has disposed therein flow guiding means, such as vane surfaces or vane extensions, to impart rotary motion to fluid passed through the movable device.

The periphery of the discharge orifice may be wholly defined by nozzle surfaces on the movable device so as to be discrete from the periphery of the outlet opening; or the periphery of the discharge orifice may be only partially defined by such discrete nozzle surfaces so as to meet the periphery of the outlet opening so that part or parts of the surface of the hollow member defining the outlet opening serve as a further nozzle surface or surfaces to define part or parts of the discharge orifice.

The nozzle surfaces may be shaped to create a plurality of the discharge orifices. The flow cross sectional area of the discharge orifice or orifices is preferably less than half, e.g. 0.01 to 0.1, of that of the outlet opening.

In some systems employing several nozzles, the rate of fluid supply may be insufficient to generate the minimum pressure required to move the movable devices while all the devices are in the normal positions, even though the working flow rate is being supplied. To avoid problems of actuation of the movable devices, the flexible body preferably serves as a combined piston and flow restrictor in its normal position in the spray nozzle. In a preferred form, the integral parts are connected by a head which serves as the piston, which head is shaped to provide a restricted fluid flow path having a flow cross-sectional area greater than the flow cross-sectional area of the created spray discharge orifice or orifices. The flow path may be defined between the head and the internal surface of the nozzle, but is preferably primarily provided by a port in the head.

In order to shut off the supply of liquid to known nozzles when the supply pressure falls below a predetermined minimum pressure, e.g. in order to reduce "dribbling" from nozzles, it is known to provide pressure sensitive shut off or check valves immediately upstream of each of the nozzles or to incorporate such a valve into a combined valve and nozzle assembly. Again, the aforementioned further problems are involved together with problems of reliability and blockage of the valves.

In order to reduce such problems, the movable device in the normal position preferably serves to block flow through the interior of the spray nozzle. In a preferred embodiment the head or hub portion cooperates with a static member to close the port in the head while leaving part of the pressure supply side face of the head exposed to any pressure supplied to the nozzle.

The static member may be employed to restrict the port, and be arranged, e.g. tapered, so that said restriction reduces progressively with the distance moved by the movable device from the normal position.

The static member may serve as a pintle which extends through the port and provides a flow modifying surface or surfaces within the movable device, e.g. to impart rotation to said flow.

The invention further includes and provides a spray nozzle of said kind characterized in that the movable device is hollow and in the normal position cooperates with a static member in the nozzle to serve as a valve closing a flow path into the movable device.

The hollow member is preferably a cap releasably secured to an inlet body, and separable from the body to provide access for removal or insertion of the movable device. The cap may incorporate a spray deflector axially offset from the outlet opening, on which a spray from the discharge nozzle can impinge.

The invention can be utilized for retro-application to some forms of known spray nozzles, and accordingly the present invention provides a movable device, insertable into a spray nozzle having a removable cap apertured to provide an outlet opening, which device comprises separable nozzle surfaces which can be brought into mutual proximity, against a bias in the movable device, to create a spray discharge orifice.

The nozzle surfaces may be configured to form a discharge orifice of any suitable geometric configuration.

The nozzle surfaces may be provided on tips of the separable parts, which tips may be of materials the same as or different from the remainder of the separable parts, e.g. metal or ceramic tips on plastics bodies or separable parts.

The movable device is preferably a molded of thermoplastics material. Preferably, the molded comprises at least two arms joined to a central portion by integral flexible hinges. In preferred embodiments the arms terminate in free end portions shaped to provide surfaces for forming the discharge orifice and further surfaces for sliding engagement with said internal surface of the spray nozzle.

DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
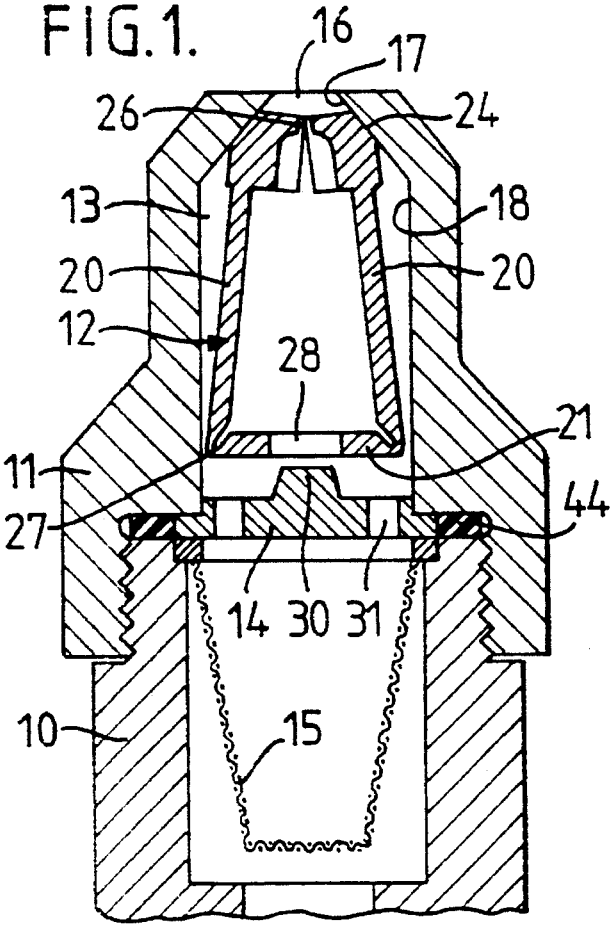
FIG. 1 shows an axial cross-section through a spray nozzle of the invention incorporating a first form of movable device of the invention in an "operative" position adopted when spraying.
Figure 2:
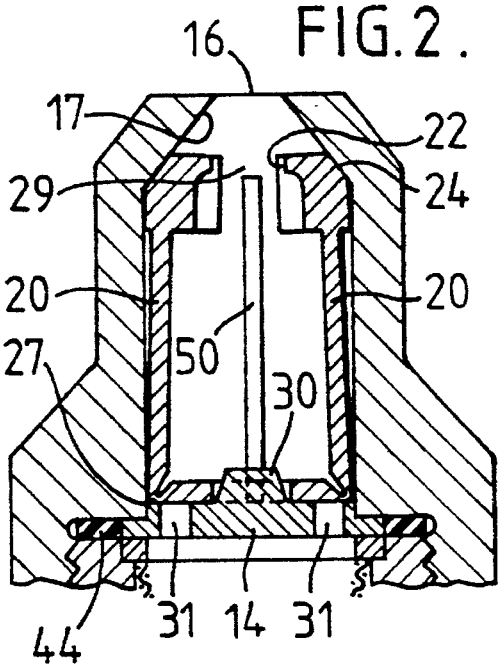
FIG. 2 shows an axial cross-section through part of the spray nozzle with the movable device in a "normal" position.
Figure 3:
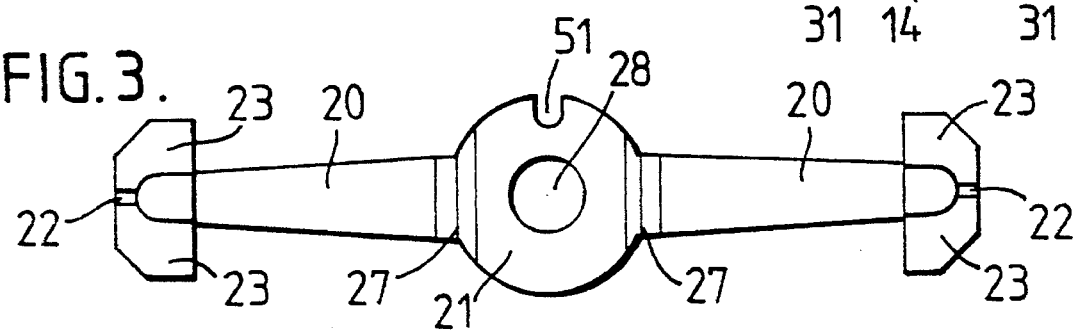
FIG. 3 shows the first form of movable device of the invention in plan in an "as molded" condition.

Referring to FIGS. 1 to 3, the spray nozzle primarily comprises a hollow inlet body 10 on which a hollow member in the form of a cap 11 is releasably mounted, and a movable device 12 movable within a cylinder 13 defined primarily by the cap. The spray nozzle may optionally also be provided with static member 14 and/or a filter 15.

The cap 11 provides an outlet opening 16, and has a conically inclined internal ramp surface 17 leading from the opening 16 to an internal cylindrical surface 18 around the cylinder 13.

The movable device 12 is in the form of a flexible body molded from plastics material so as to comprise parts which form arms 20 connected together by a head or hub portion 21. Each arm 20 provides, on its free end portion, a nozzle surface 22, at least one abutment surface 23 (FIG. 3) and a slider surface 24 (FIG. 2) in a predetermined mutual configuration. In the embodiment shown in FIGS. 1 to 3, two arms 20 are provided and the surfaces 22 are configured so that when the surfaces 23 abut (FIG. 1) the surfaces 22 define between them a discharge orifice 26 smaller than and concentric with the outlet opening 16.

The head or hub portion 21 is dimensioned to be a sliding fit in the cylinder, and is provided with an axial port 28 providing a restricted flow path for fluid to flow into the movable device 12.

Each arm 20 is joined to the head 21 by an integral resilient hinge 27 so that the arms can be swung together against an inherent resilient resistance from the "as molded" condition shown in FIG. 3 for insertion of the device into the cylinder 13 so that the slider surfaces 24 are in contact with the ramp surface 17 (FIG. 2) in the normal position of the device 12. As is evident in the drawings and as inherently disclosed herein, arms 20 are resiliently connected at one end thereof to head or hub portion 21 to allow movement of arms 20 between an unbiased condition and a biased condition.

The ramp surface 17 is inclined to the central axis of the cylinder 13 at an angle determined so that the reaction to forcible engagement of the slider surfaces with the ramp surface (because of the radially outwardly directed force applied to the arms by said resilient resistance) produces a rearwardly directed bias acting to urge the movable device axially away from the outlet opening 16 and towards the normal position, e.g. about 30°. In the normal position said abutment surfaces 23 are separated so that the surfaces 22 no longer define any discharge orifice 26 and merely lie in a relatively wide flow path 29 to the rear of the outlet opening (FIG. 2).

In use, in the absence of the static member 14 and filter 15, when fluid is initially supplied to the nozzle, the initial resistance to flow through the nozzle is primarily determined by the area of the restricted flow path i.e. the area of the port 28, the liquid will initially flow through the wide flow path 29 between the arms to the opening 16 until the force imparted to the head 21 (which serves as a piston under these conditions) is sufficient to overcome the bias (and friction of the engagement of the surfaces 24 and 17) and thereby drives the device to move forward towards the outlet. This forward movement causes the free end portions of the arms to be forced towards the axis, as the surfaces 24 traverse the ramp surface 17, until the abutment surfaces 23 abut and the discharge orifice 26 is formed when the device reaches the operative position. In the operative position the ramp surface 17 serves also as a sealing abutment surface and the slider surfaces 24 serve also as sealing surfaces which engage the surface 17 to provide a seal preventing fluid from by-passing the orifice 26; and the resistance to flow through the nozzle is greater than the initial resistance and is determined primarily by the dimensions of the orifice 26.

The wide flow path 29 preferably has a minimum flow cross-sectional area about the same as that of the outlet opening 16.

The initial flow serves as a flushing flow to remove particles of matter which could otherwise restrict or block the orifice 26.

The simple example just described involves a compromise between the necessity of generating a sufficient piston force and the desirability of keeping the port 28 sufficiently large to reduce the probability of the port 28 becoming blocked. This compromise is not significant where the fluid supply is sufficient, but could be detrimental if the rate of said supply is restricted. In the latter case the compromise can be avoided by locating a static flow restrictor 30 in the cylinder so that it restricts the port 28 in the normal position of the device and until the device has moved forwards to take the port clear of the restrictor, and has thereby moved the arms radially towards each other to an extent sufficient to cause the resistance to flow to be substantially determined by the spacing between the surfaces 22 and/or 23. The static restrictor 30 is arranged to permit a flushing flow, and also serves as a plunger or wiper to clear the port as the device returns to the normal position.

The restrictor 30 may be dimensioned to close the port completely in the normal position, and, if the head 21 of the device 12 is a sufficiently close fit in the cylinder, the restrictor and head will serve as a non-return valve, to prevent further, i.e. leakage, flow through the nozzle, and, if the filter 15 is included, to keep the filter bathed in the fluid.

However, the head 21 is preferably a clearance or free sliding fit in the cylinder, and, if a non-return valve function is required, the static member 14 is employed. The static member is primarily an apertured disc in which the apertures 31 do not register with the port 28 so that when the head abuts the disc the port is closed while part of the surface of the head 21 remains exposed for application of fluid pressure via the apertures 31, as shown in FIG. 2.

In such a form of the spray nozzle, the disc 14 is positioned to limit the stroke of the device 12 so that in the normal position the surfaces 24 remain in contact with the ramp surface 17 whereby to maintain said rearwards bias and force the piston to abut the disc. Initial forwards movement is thus initiated by the pressure of the fluid supply imparting the required minimum force to the piston, prior to commencement of flow through the flow passages.

The restrictor 30 may optionally be provided or mounted on the disc 14, as shown.

Figure 4:
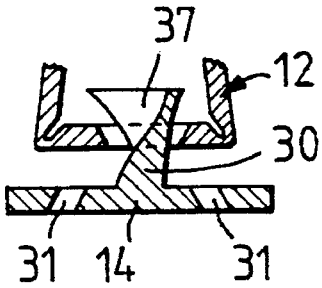
FIG. 4 shows an axial section through a modified static member and part of the movable device for use in the spray nozzle.
Figure 5:
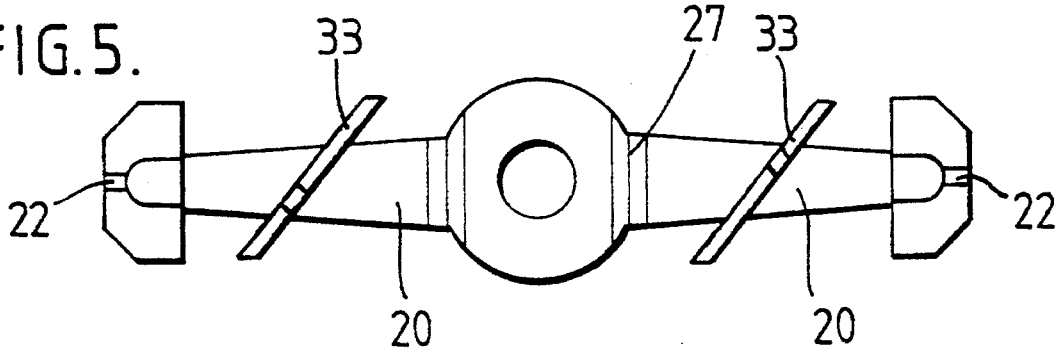
FIG. 5 shows a second form of the movable device in plan in an "as molded" condition.
Figure 6:
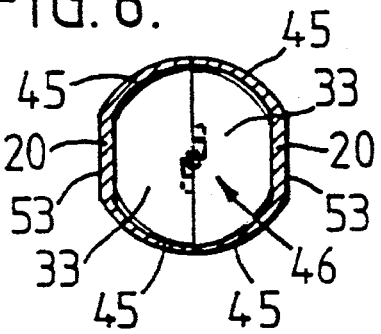
FIG. 6 shows a cross section through a further modified form of the movable device.

The movable device 12 may be molded to provide vanes 33 to impart rotation to the flow, e.g. as shown in FIGS. 1 and 5; or an extra arm or arms 34 carrying a vane 35 may be provided on the device e.g. as shown in FIG. 5. A swirl vane 37 may be provided on the restrictor 30, and the ports 31 may be inclined to promote swirl as indicated in FIG. 4. The arms may have lateral extensions 45, indicated in broken lines in FIG. 5, which abut in the operative position to provide within the arms 34 a smooth walled, almost circular in section, swirl chamber 46 (FIG. 6).

Figure 7:
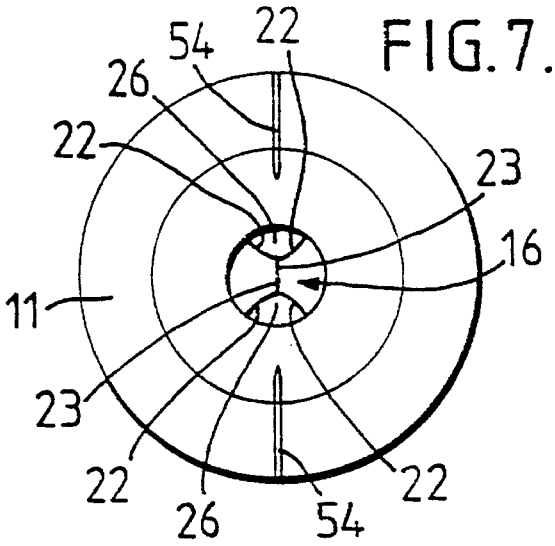
FIGS. 7, 8 and 9 show front end views of variations of the nozzle providing different spray patterns.

The shape and number of the discharge orifice or orifices is determined by the form of spray required. For example, the abutment surface 23 on an arm 20 may lie between two nozzle surfaces 22 each of which extends to an edge of the arm, as shown in FIG. 7, so that in the operative position, the edges abut the surface of the outlet opening 16 with the result that a pair of discharge orifices 26 partially concomitant with the opening 16 are formed within the opening by the surfaces 22.

Figure 8:
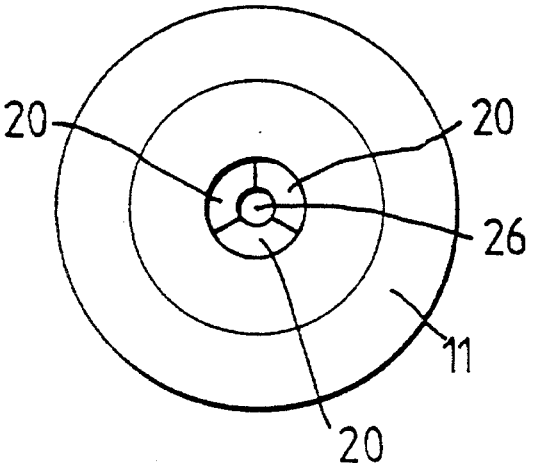
Figure 9:
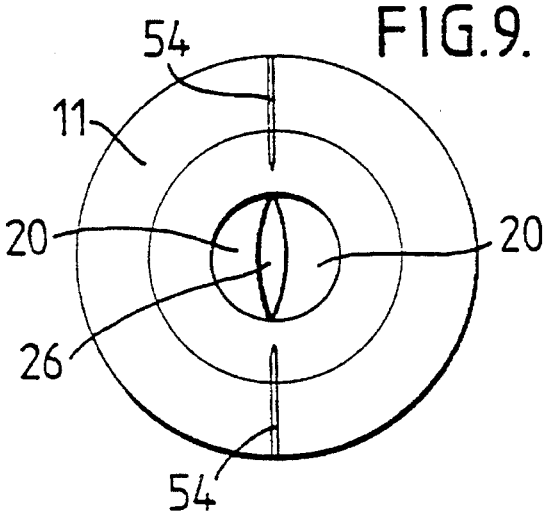
Figure 12:
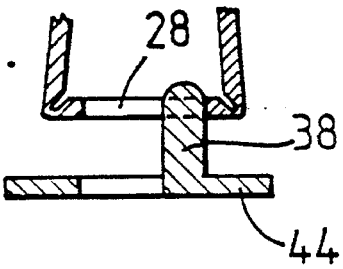
FIG. 12 is a view similar to FIG. 4 showing a further modified form of static member and device.
Figure 13:
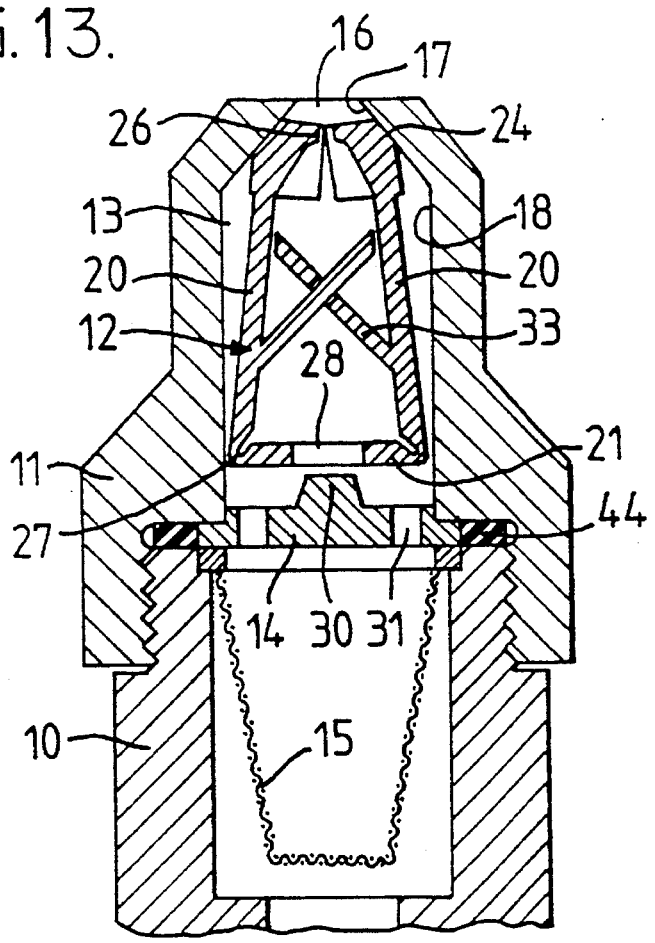
FIGS. 13 and 13A are axial cross-sections through a spray nozzle and a piston insert device, respectively, of the invention showing two other embodiments of a piston insert device of the invention.
Figure 14:
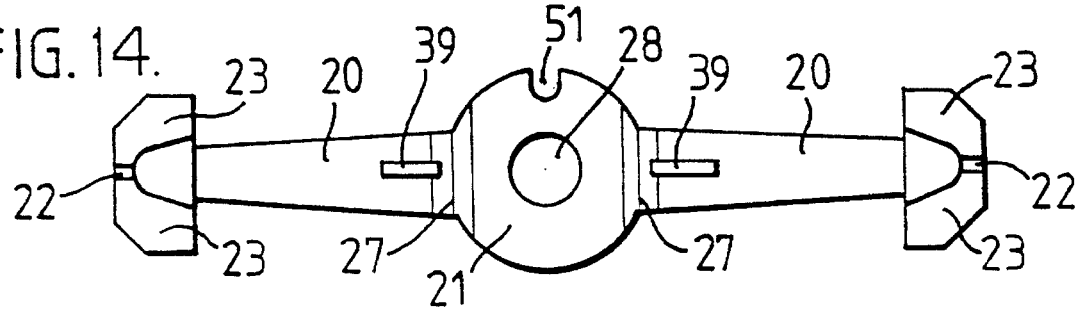
FIG. 14 is a plan view of the piston insert device of the invention in FIG. 13A and shown in an "as molded" condition.
Figure 15:
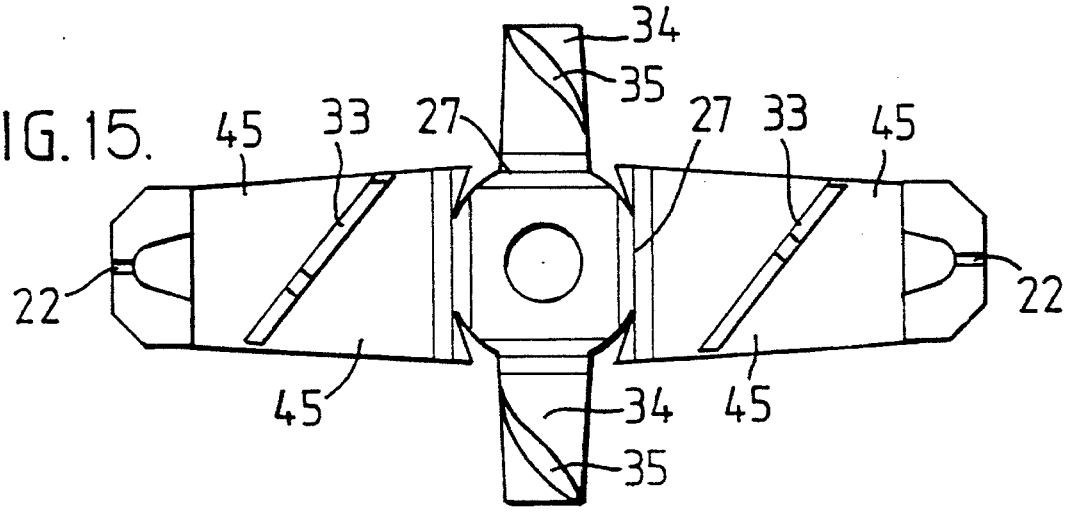
FIG. 15 is a plan view of the piston insert device of the invention shown in FIG. 13 and in an "as molded" condition.
Figure 13A:
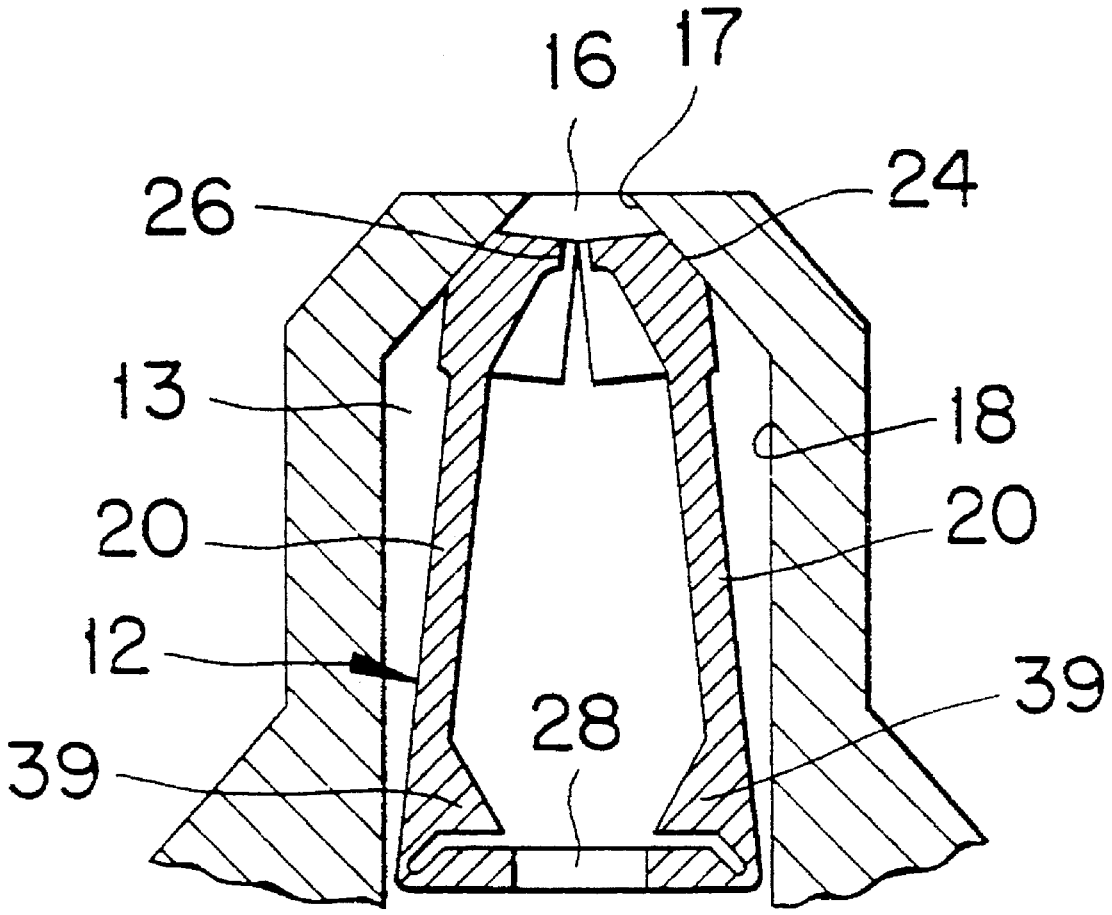

More than two arms 20 may be employed, e.g. three arms 20 as shown in FIG. 8, at equal or unequal angular intervals around the head.

Where the discharge opening 26 is non-circular, e.g. elongate, as shown in FIG. 9, or where a spray pattern assymetric to the axis or of non-circular form is required, the axial orientation of the device 12 in the cylinder 13 may be determined by any suitable guide means. For example, the port 28 may be of keyhole form, and a modified form of the static member 14 having a guide finger 38 thereof parallel to the axis to engage in the eccentric portion of the port, as shown in FIG. 12, may be employed as the guide means. However, it is preferred to provide the cylinder with an axially directed rib 50 to engage in a recess 51 in the head 21 (FIGS. 2 and 3) or to provide a keyway in the cylinder to receive a radially directed projection on the periphery of the head 21. As can be seen in FIG. 6, the hinges 27 provide chordal flats 53 on the periphery of the head, and to prevent rotation of the insert, the cylinder may have corresponding chordal flats, not shown. Markings 54 may be provided on the cap 11 to indicate the orientation of the device 12 and thus the spray pattern.

The resilient resistance from which the bias is derived may be supplemented, e.g. by extending the vanes 33 to abut so as to urge the arms 20 apart; by using the vane 35 on the arm 34 to urge the arms 20 apart; by forming buttresses 39 on the arms 20 to engage and react against the head 21 to urge the arms radially outwards (FIGS. 1 and 3); or by any combination thereof.

Figure 10:
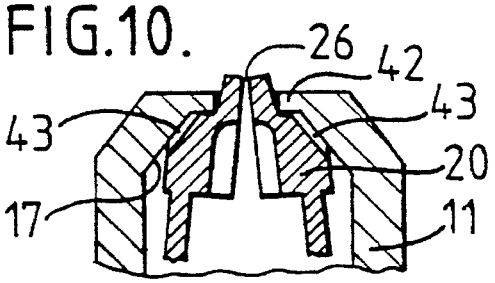
FIG. 10 is an axial sectional view through a first part of a further modified form of the nozzle.
Figure 11:
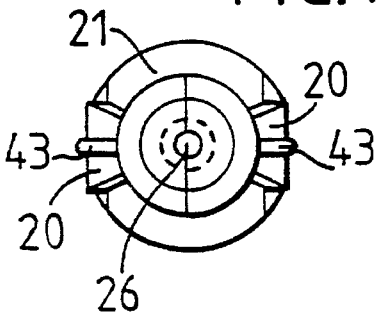
FIG. 11 is a front end view of the device on its own in the operative condition with the cap shown in FIG. 10 removed.

A stop surface or flange 42 on the cap may usefully be employed to seal against the end portions of the arms to prevent flow bypassing the discharge orifice or orifices; and in such embodiments the slider surfaces 24 may be provided by narrow ribs 43 on the arms 20 to reduce friction in the engagement with the ramp surface (FIGS. 10 and 11).

The end portions of the arms 20 may, in the operative position, project forwards beyond the outlet opening 16 (FIG. 10), to be co-terminus with the outlet opening (FIG. 8), extend into the outlet opening (FIG. 7) or terminate to the rear of the outlet opening (FIG. 1).

In all embodiments, movement (and optional flexing) of the movable device 12 serves to dislodge, and/or break up solid or non-fluid deposits, on the device, for removal thereof together with other particles by flushing flow, for automatic self cleaning or unblocking of the nozzle. Repeated interruption of the fluid supply can be employed to facilitate cleaning and/or unblocking of the nozzles.

The invention is not confined to details of the foregoing examples, and many variations and modifications are possible within the scope of the invention.

For example, the cap may provide merely the stop surface or flange 42 or the ramp surface 17, the remaining cylinder surfaces 17 and 18 or surface 18 being provided by the inlet body 10 or by a suitably shaped insert (not shown) inserted into the interior of the nozzle.

In the event of a shaped insert being employed, components such as the static member 14 and/or filter 15, together with the device 10, or any thereof, may be pre-assembled with the insert to form an assembly to facilitate adaptation of a known form of nozzle, or repair or refurbishment of a nozzle in accordance with the invention.

The member 14 and filter 15 need not be located at a junction between the cap and body, even though it is convenient to locate the member 14 by means of a junction seal washer 44 and a locating flange on the filter as shown in FIG. 1.

The terms and expressions employed herein are by way of example and include within the scope thereof applicable generic terms and synonymous and functional equivalents.

The invention further provides a nozzle, movable device or assembly comprising any novel part, feature or functional arrangement disclosed herein or in the accompanying drawings, or any novel combination of parts, features or functional arrangements so disclosed.

For example the invention further provides and includes a spray nozzle having a hollow member defining an outlet opening and a device movable within the nozzle between a normal position in which the outlet opening is unrestricted or minimally restricted and an operating position defining a discharge orifice within or proximal to the outlet opening and having a flow cross-sectional area less than half that of the outlet opening.

I claim:

1. A spray nozzle comprising:

a) a hollow member having an outlet opening located on a front side of the spray nozzle, b) movable means disposed within the nozzle and rearwardly biased to a normal position for providing a flow of fluid through outlet opening, c) the movable means being movable under fluid pressure from the normal position in a forward direction toward the outlet opening to obstruct said flow of fluid to the outlet opening and to cause relative movement between separable portions of the movable means to create a spray discharge orifice, smaller than the outlet opening, adjacent the outlet opening, and d) the movable means including a hub portion resiliently connected to said separable portions to cause said separable portions to separate for providing rearward bias of the movable means toward the normal position.

2. A spray nozzle as defined in claim 1 wherein the discharge orifice has a periphery that is wholly defined by nozzle forming surfaces on the separable portions.

3. A spray nozzle as defined in claim 1 wherein the movable means includes a movable device composed of molded thermoplastics material.

4. A spray nozzle comprising:

a) a hollow member having an outlet opening located on a front side of the spray nozzle, b) movable means disposed within the nozzle and rearwardly biased to a normal position for providing a flow of fluid through the outlet opening, and c) fluid pressure means for moving the movable means from the normal position in a forward direction toward the outlet opening to obstruct said flow of fluid to the outlet opening and to cause relative movement between separable portions of the movable means to create a spray discharge orifice, smaller than the outlet opening, adjacent the outlet opening, d) the separable portions including outer end structures for forming the discharge orifice therebetween and for providing rearward bias of the movable means, e) the discharge orifice having a periphery that is defined by a combination of nozzle surfaces on the outer end structures of the separable portions and a portion of the surface of the outlet opening.

5. A spray nozzle as defined in claim 4 wherein said nozzle surfaces define a plurality of spray discharge orifices.

6. A spray nozzle comprising:

a) a hollow member having an outlet opening located on a front side of the spray nozzle, b) movable means disposed within the nozzle and rearwardly biased to a normal position for providing a flow of fluid through the outlet opening, and c) fluid pressure means for moving the movable means from the normal position in a forward direction toward the outlet opening to obstruct said flow of fluid to the outlet opening and to cause relative movement between separable portions of the movable means to create a spray discharge orifice, smaller than the outlet opening, adjacent the outlet opening, d) the separable portions including outer end structures for forming the discharge orifice therebetween and for providing rearward bias of the movable means, e) the movable means in the normal position cooperates with a static member for closing a flow path into the movable means.

7. A spray nozzle comprising:

a) a hollow member having an outlet opening located on a front side of the spray nozzle, b) movable means disposed within the nozzle, c) biasing means for urging the movable means rearwardly to a normal position in which the movable means allows a flow of fluid through the outlet opening, d) fluid pressure means for moving the movable means by fluid pressure from the normal position in a forward direction toward the outlet opening to obstruct the flow of fluid to the outlet opening and to cause relative movement between separable portions of the movable means to create a spray discharge orifice, smaller than the outlet opening, adjacent to the outlet opening, and e) said biasing means being effective to cause said separable portions to separate and to react against an internal surface of the spray nozzle to indirectly provide said rearwardly urging of the movable means.

8. A spray nozzle as defined in claim 7 wherein the movable means includes a body member incorporating said separable portions, and being composed of at least partially resilient material and serving to provide said rearwardly urging of the separable portions away from each other to react against said internal surface of the spray nozzle.

9. A spray nozzle as defined in claim 7 wherein in the normal position, the movable means cooperates with a static member in the nozzle to restrict an opening into the movable means.

10. A spray nozzle as defined in claim 7 wherein the movable means includes a flexible body which serves as a combined piston and flow restrictor in the normal position within the spray nozzle.

11. A spray nozzle as defined in claim 7 wherein the hollow member is a cap releasably secured to an inlet body, and the cap is separable from the inlet body to provide access for removal or insertion of the movable means.

12. A spray nozzle as defined in claim 7 wherein guide means slidably engages the movable means to prevent rotation of the movable means.

13. A spray nozzle comprising:

a) a hollow member having an outlet opening located on a front side of the spray nozzle, b) a movable device disposed within the nozzle, c) means for rearwardly biasing the movable device to a normal position in which the movable device allows a flow of fluid through the outlet opening, d) means for moving the movable device by fluid pressure from the normal position in a forward direction toward the outlet opening to obstruct the flow to the outlet opening and to cause relative movement between separable portions of the movable device to create a spray discharge orifice, smaller than the outlet opening, adjacent to the outlet opening, e) the movable device is hollow and includes vane means to impart rotary motion to fluid passed through the movable device.

14. In a spray nozzle having a longitudinal axis, a movable device comprising:

a) a flow restricting piston body member including a plurality of arms flexibly connected by hinge portions to a head, b) said body member being disposed to move along said longitudinal axis between a rearward normal position and a forwardly disposed operative position, c) said arms including end portions shaped to abut for defining at least a portion of a spray discharge orifice when the body is resiliently compressed to move said end portions toward each other under fluid pressure directed outwardly from the spray nozzle, d) said hinge portion being effective to resiliently urge the arms outwardly away from the longitudinal axis against inclined surface means to bias the piston body member toward said normal position.

15. A spray nozzle including an outlet opening located on a front side of the spray nozzle, said nozzle comprising:

a) a hollow member having a longitudinal axis and internally inclined surface means convergent towards said longitudinal axis and outlet opening, b) flow restricting piston means disposed to move parallel to the longitudinal axis and within the hollow member between a rearwardly disposed normal position to allow a flow of fluid through said outlet opening and a forwardly disposed operative position under fluid pressure to restrict the flow of fluid, c) said piston means including biasing means and separable portions that under fluid pressure form a discharge orifice which is smaller than said outlet opening, d) said biasing means being effective to continually urge said separable portions in a direction transverse to and away from the longitudinal axis to push against said inclined surface means for producing a rearward bias upon the piston means toward said normal position and against said fluid pressure when the piston means is in an operative position.

16. A spray nozzle as defined in claim 15 wherein the hollow member includes internal guide means to engage said pisoton means and prevent rotation of the piston means.

17. A spray nozzle as defined in claim 15 wherein the separable portions include nozzle forming surfaces that define a discharge orifice having a non-circular periphery.

18. A spray nozzle as defined in claim 15 wherein said piston means includes a body member incorporating said separable portions which are resiliently mounted to provide said biasing means.

19. A spray nozzle as defined in claim 15 wherein said piston means includes a body member having a hub portion and a plurality of arm members pivotally connected to the hub portion, each said arm member includes an outer end section that carries a said separable portion.

20. A spray nozzle as defined in claim 15 wherein said piston means includes a flexible body having a plurality of arms each with a resilient connection to pivot with respect to a hub portion, each said arm carries a said separable portion and is foldable to one side of the hub portion with the resilient connection urging the separable portions in a direction away from each other and against static surface means within the hollow member to bias the piston means toward the rearwardly disposed normal position.

21. A spray nozzle as defined in claim 20 wherein said static surface means includes internal inclined surface means, and said separable portions include discharge orifice facing surfaces and outwardly directed inclined surfaces in sliding contact with said inclined surface means of said static surface means.

22. A spray nozzle as defined in claim 21 wherein the internal inclined surface means converges toward the outlet opening and is disposed at an angle with the longitudinal axis within the range of 20° to 40°.

23. A spray nozzle as defined in claim 20 wherein the flexible body is molded in one piece and composed of thermoplastics material.

24. A spray nozzle as defined in claim 20 wherein said static surface means includes a sealing abutment surface adjacent the outlet opening, and said separable portions include abutment surface engaging surfaces to provide a seal when the piston means is in an operative position to prevent fluid by-passing the discharge orifice.

25. A spray nozzle as defined in claim 15 wherein the piston means includes means to impart rotational motion to fluid passing through said outlet opening.

26. A nozzle insert device for controlling fluid flow through a nozzle, said device comprising:

a) a flexible body member including a plurality of arms resiliently connected at one end thereof to a hub portion to allow movement of the arms between an unbiased condition and a biased condition and having outer end sections with discharge orifice facing surfaces on one side thereof, b) said arms being effective to pivotably fold with respect to the hub portion for moving said outer end sections toward each other so that said discharge orifice facing surfaces define a discharge orifice, c) said flexible body means is composed of molded plastics material as a single flat element with at least two arms extending outwardly from said hub portion, and d) said body member is insertable into a hollow nozzle member when each of the arms is pivotally folded toward each other to one side of the hub portion.

27. A nozzle insert device as defined in claim 26 wherein each said outer end section includes an inclined outwardly directed sealing surface which abuts an inclined surface on the inside of said hollow nozzle member.

* * * * *